United States Patent [19]

Müller

[11] Patent Number: 4,951,298

[45] Date of Patent: Aug. 21, 1990

[54] CLOSED REMELTING FURNACE HAVING SEVERAL HORIZONTALLY MOVABLE FURNACE LOWER PORTIONS

[75] Inventor: Felix Müller, Biebergemünd, Fed. Rep. of Germany

[73] Assignee: Leybold Aktiengesellschaft, Hanau, Fed. Rep. of Germany

[21] Appl. No.: 391,958

[22] Filed: Aug. 9, 1989

[30] Foreign Application Priority Data

Jun. 2, 1989 [DE] Fed. Rep. of Germany ..... 3917998

[51] Int. Cl.[5] ..... F27B 14/04; H05B 7/102

[52] U.S. Cl. ..... 373/67; 373/69; 373/68

[58] Field of Search ..... 373/67, 68, 69, 94, 373/95

[56] References Cited

U.S. PATENT DOCUMENTS

| | | | |
|---|---|---|---|
| 2,916,536 | 12/1959 | Gruber et al. | 373/68 |
| 2,973,452 | 2/1961 | Garmy | 373/94 |
| 3,118,013 | 1/1964 | Garmy | 373/68 |
| 3,146,289 | 8/1964 | Cooper et al. | 373/68 |
| 3,190,949 | 6/1965 | Gruber | 373/67 |
| 3,246,070 | 4/1966 | Wooding | 373/68 |
| 3,665,084 | 5/1972 | Samietz | 373/68 |
| 3,912,848 | 10/1975 | Randa | 373/68 |

*Primary Examiner*—Roy N. Envall, Jr.
*Attorney, Agent, or Firm*—Felfe & Lynch

[57] ABSTRACT

A closed remelting furnace 1 includes a vertical furnace axis A-A, an electrode supporting rod 15 for a consumable electrode 23, a furnace body 29 which has a driving mechanism for the electrode supporting rod and several furnace lower portions 6, 7 each of which has an ingot mold 9 including an ingot mold axis K-K. A furnace upper portion 11 and the furnace lower portions can individually, if desired, be aligned by means of a lateral relative movement. Through a sealed passage the electrode supporting rod is passed through a top limiting wall 16 of the furnace upper portion 11. In order to reduce the total height and labor and cost involved in design and construction the furnace upper portion 11 is subdivided in two partial segments 13, 19 along a horizontal separating groove. The upper partial segment 13 is configured so as to be short as compared to the total height of the furnace upper portion and constantly associated with the electrode supporting rod 15 and the lower partial segment 19 can be moved out of the area of the furnace axis A-A by means of transporting device.

13 Claims, 3 Drawing Sheets

Figure 1:
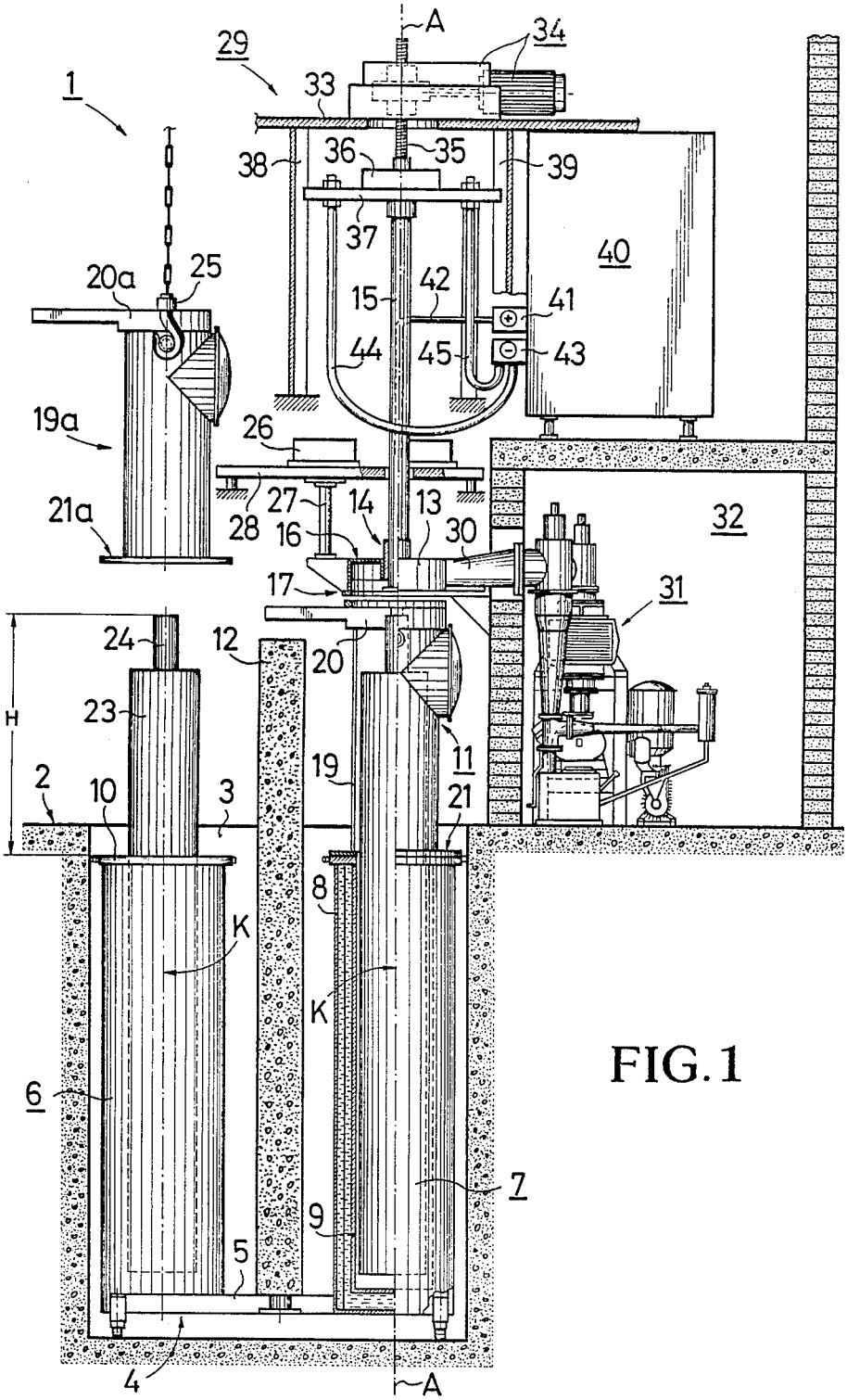

CLOSED REMELTING FURNACE HAVING SEVERAL HORIZONTALLY MOVABLE FURNACE LOWER PORTIONS

The invention relates to a closed remelting furnace including a vertical furnace axis (A—A), an electrode supporting rod which can moved along this axis to hold a consumable electrode, a furnace body which includes a driving mechanism for the electrode supporting rod, several furnace lower portions each of which holds an ingot mold with an ingot mold axis (K—K) and which can be aligned, individually if desired, with the furnace axis by a lateral movement with respect to the furnace upper portion; with the passage being sealed the electrode supporting rod is passed through a top limiting wall of the furnace upper portion which is connected with a device for generating a protective atmosphere and in melting position it is concentrically directed towards the furnace axis and it can be gas-tight connected to the furnace lower portion.

In such furnaces gas atmospheres can be generated having a composition which is different from the one of the surrounding air. It is thus possible to generate in such remelting furnaces a protective atmosphere by means of an inert gas which corresponds to atmospheric pressure but can also be maintained at a higher or lower pressure. Further, it is possible to generate in a closed remelting furnace a gaseous atmosphere which can interact as desired with a melt in the furnace. Finally, it is possible to maintain in such furnaces a vacuum in order to favor an additional evaporation of such impurities which are easily volatile at melting temperature.

Hence, a gas source and/or a vacuum pumping device can serve as a device for generating a protective atmosphere.

The US-PS No. 3,190,949 discloses a closed remelting furnace of the aforesaid kind which is configured as a vacuum furnace and in which several furnace lower portions having ingot molds are disposed in the nature of a revolver, i.e they are rotatable around a central axis and can be individually and axially aligned with the furnace upper portion. The furnace upper portion is supported in a furnace body and can, alternatively, be moved in a vertical direction with respect to the furnace lower portions; it is configured as a single row and as a slim hollow cylinder and closed at the top end by means of a vertical front wall through which the electrode is passed through in a sealed passage.

In such furnaces it is necessary that the consumable electrode be significantly longer than the ingot mold into which it is remolten. Hence, during the typical charging procedure the consumable electrode significantly extends over the top edge of the furnace lower portion and the ingot mold. In order to couple the furnace upper portion to the furnace lower portion it is hence required either to correspondingly lower all furnace lower portions (as in prior art) or to lift the furnace upper portion correspondingly so as to be able to place in the furnace upper portion the top end of the consumable electrode including the stub. Both measures require a significant height of the entire furnace system since the furnace upper portion must be associated with the electrode supporting rod and the electrode driving mechanism such that it is locally fixed and the latter two are, by design, combined with the furnace body. Prior art therefore determines that the pit holding the furnace lower portions is approximately twice as deep as the axial lengths of the ingot molds and the furnace lower portions.

It must also be taken into account that a corresponding lifting of the furnace upper portion would cause problems because the furnace upper portion is usually connected to the vacuum pumping device. The possibility to detach and/or the flexible configuration of the vacuum suction pipes which have to have a corresponding cross section, however, is extremely difficult to accomplish and involves a great deal of labor and cost.

It is hence an object of the invention to improve a closed remelting furnace of the aforesaid kind such that the height of the entire system and the construction involved for carrying out a change of charges can be reduced.

The object is accomplished for a closed remelting furnace of the aforesaid kind in accordance with the invention in that the furnace part along its horizontal separation groove is subdivided in two partial segments. The upper partial segment thereof which is provided with said limiting wall (including the electrode supporting rod passed through) is configured short in relation to the total height of the furnace upper portion and the lower partial segment thereof can be moved out of the area of the respective furnace axis (A—A) by means of a transport device.

The subdivision of the furnace upper portion in accordance with the invention permits—as it will be explained based on an embodiment—slightly lifting only the upper partial segment of the furnace upper portion, i.e. by a few mm (or lowering the furnace lower portion correspondingly) and subsequently, laterally swinging the furnace lower portion together with the lower partial segment of the furnace upper portion out of the area of the furnace axis A—A, i.e. swinging out of the area of the axis of the electrode supporting rod and simultaneously recharging the furnace.

The entire furnace construction thus has a significantly reduced total height and it includes a smaller number of lighter individual parts. The result is that the foundation symmetrically receives and holds the consumable electrode such that a disadvantageous one-sided loading of the furnace body is avoided. Consequences are, furthermore, an improved coaxiality by omitting the usual lifting column and the symmetric configuration of the furnace body. Short pipes are possible for the melting current and the suction lines (in case of vacuum furnaces).

When vacuum pumps are used the pumping capacity of the so-called booster pumps can be reduced by 50%.

A preferred embodiment of the invention is characterized in that the lower partial segment of the furnace upper portion is provided with a jacket including a sealing flange at its lower end which can be gas-tight connected to the upper sealing flange of the furnace lower portion. It is of particular advantage when the jacket is, at its upper end, provided with a valve chamber and a stop valve.

This valve chamber is placed between the lower and the upper partial segment of the furnace upper portion. Once the remelting process is completed it is possible, for example, to first close the stop valve and separate the upper partial segment of the furnace upper portion from the furnace parts placed directly underneath and laterally remove the latter from the area of the furnace axis (A—A). While this is carried out the furnace lower portion is still rigidly and gas-tight connected to the lower partial segment of the furnace upper portion and the (closed) stop valve such that the still hot melt and the also hot rest of the consumable electrode are further hermetically sealed with respect to the surrounding area; now, the cooling can be carried out to temperatures at which the furnace lower portion can be flooded without hesitating.

A corresponding wiring of the furnace parts in the melting position ensures a secure voltage transmission between the flanges of the connection even without spring contacts. Affecting possibly present weight measuring devices for monitoring and/or controlling the remelting process is also avoided by the furnace design in accordance with the invention.

A further preferred embodiment of the invention is characterized in that the cylindrical jacket of the upper partial segment of the furnace upper portion is provided with a connecting piece for the device for generating the protective atmosphere. Since said upper partial segment constantly remains inside the furnace body and has to carry out either no lifting or only a lifting of minor length a reliable connection with the vacuum pumps is possible in case a vacuum furnace is employed.

Figure 2:
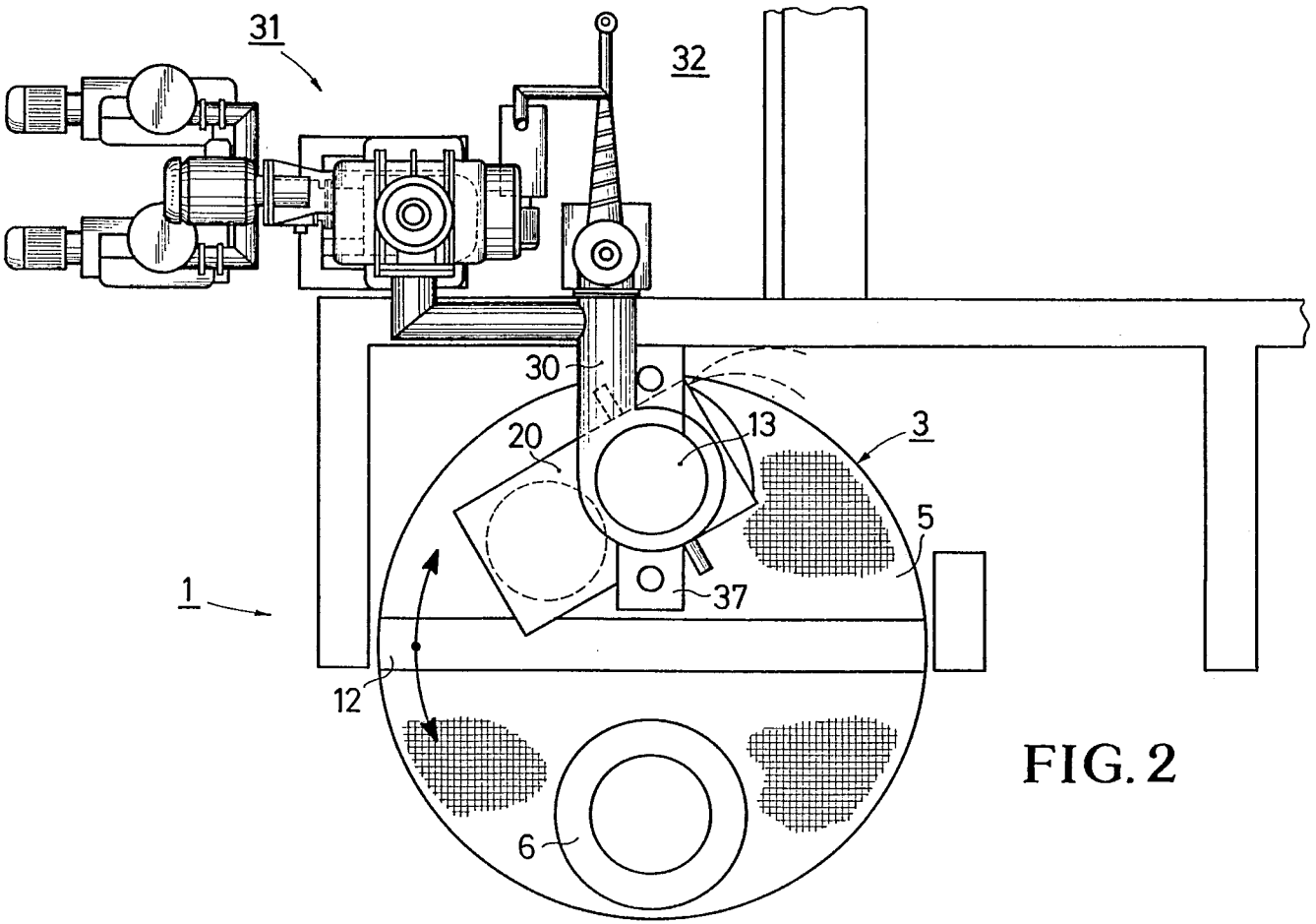
Figure 3:
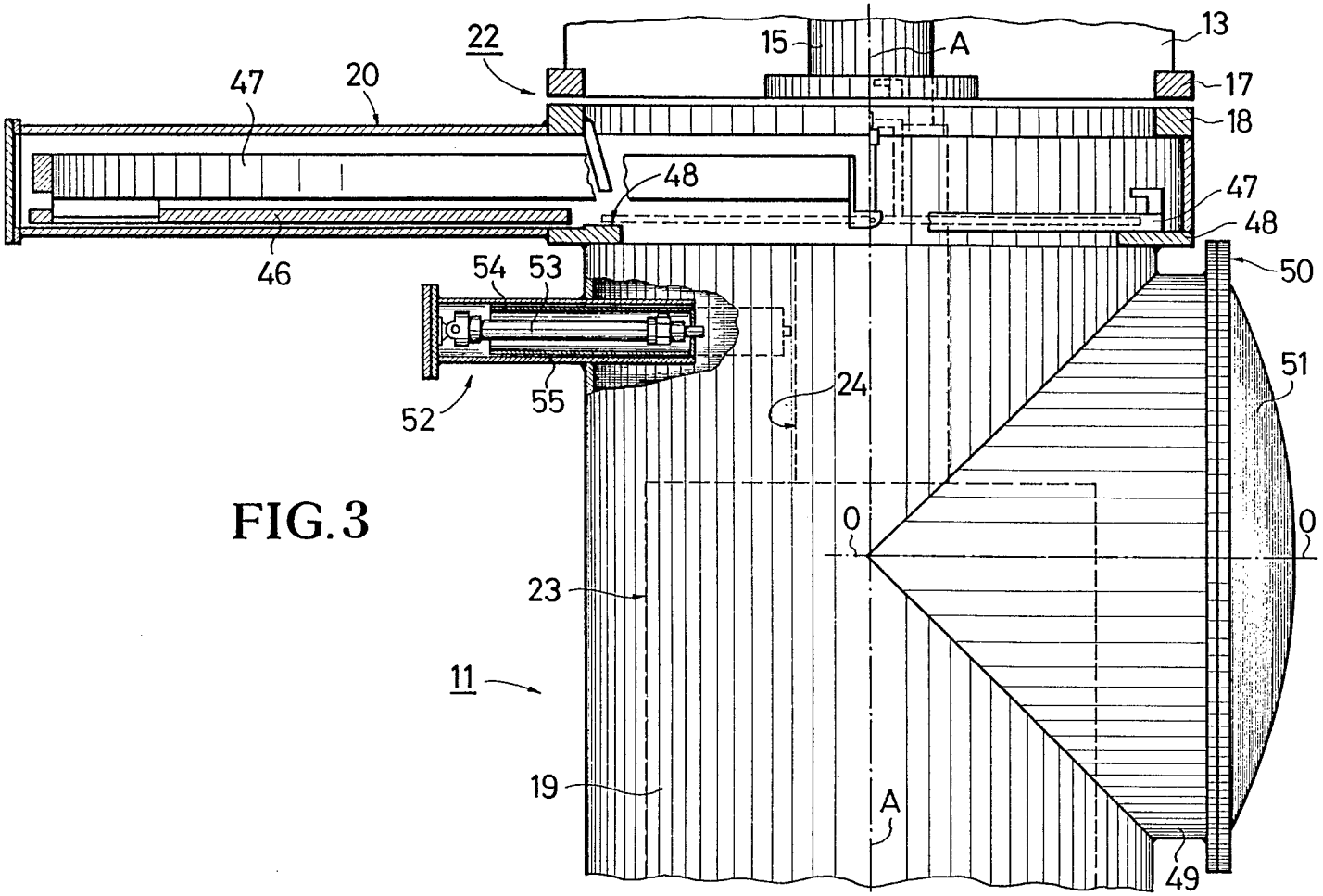

Further advantageous configurations of the invention can be gathered from the remaining subclaims. FIGS. 1 to 3 explain an embodiment of the invention in further detail hereinafter.

Referring to the Figs.

FIG. 1 is a partial sectional view of a complete remelting plant including a remelting furnace in accordance with the invention, FIG. 2 is a top view on the center and lower part of the remelting plant according to FIG. 1 and FIG. 3 is a fractional view from the center of FIG. 1 including an additional device in an enlarged scale.

FIG. 1 illustrates a closed remelting furnace placed on the bottom of a factory hall 2 in which a pit 3 is provided. In this pit 3 there is an undercarriage 4 which is configured as a rotary carriage in the present case and has a circular discoidal platform 5 on which there are disposed two cylindrical furnace lower portions 6 and 7. Each of the furnace lower portions includes a cylindrical cooling jacket 8 in which is coaxially inserted an also cylindrical ingot mold 9. The cylindrical gap between cooling jacket 8 and ingot mold 9 is passed through by cooling water and subdivided by a water baffle plate which is also concentric and not further referenced. At its top edge the ingot mold 9 has an ingot mold flange 10 which serves for placing the furnace upper portion 11 which is subsequently described in further detail.

Between the two furnace lower portions 6 and 7 there is an additional separating wall 12 made of concrete which diametrically subdivides the approximately cylindrical space in the pit 3 (FIG. 2).

The furnace upper portion 11 includes a relatively shorter upper partial segment 13 through which an electrode supporting rod 15 is passed through gas-tight by means of a sealing element 14. The upper partial segment 13 is also configured as a cylindrical jacket the upper limiting wall 16 of which contains the sealing element 14. At the lower edge the upper partial segment 13 is provided with a sealing flange 17 which can be gas-tight placed on a further sealing flange 18 at the upper end of the lower partial segment 19 of the furnace upper portion 11 (FIG. 3). At the upper end of the lower partial segment 19 there is a valve chamber 20 the details of which are further explained based on FIG. 3.

Further, the lower partial segment 19 has at its lower end a sealing flange 21 which can be gas-tight placed onto the ingot mold flange 10.

A separating groove 22 to which particular significance is attached in the invention is formed between the upper partial segment 13 and the lower partial segment 19. It is this separating groove which subdivides the furnace upper portion 10 into said partial segments of which the upper partial segment is relatively short as compared to the total height of the furnace upper portion and the lower partial segment is relatively long. The required minimum length can be gathered from FIG. 1: On the left side of the separating wall 12 a furnace lower portion 6 is represented which is open toward the top and into which a consumable electrode 23 including a supporting piece 24 (a so-called "stub") is inserted for charging purposes. The lower partial segment 19 should therefore basically have a height H which corresponds to the partial segment of the consumable electrode 23 inclusive of the supporting piece 24 which is placed above the ingot mold flange 10.

Further the top left of FIG. 1 shows an additional lower partial segment 19*a* which includes a valve chamber 20*a* and is suspended on a crane hook 25. By means of lowering, this furnace upper portion 11*a* can, with its bottom sealing flange 21*a*, be placed onto the ingot mold flange 10; subsequently, the entire arrangement is, in a vertical direction, brought into a position as represented on the right of the separating wall 12. In this position the ingot mold axis K is aligned with the furnace axis A—A.

With its bottom sealing flange 17 the upper partial segment 13 can then be placed onto the top sealing flange 18 of the valve chamber 20. A collar of lifting cylinders 26 each having a piston rod 27 serves to produce this axial movement. The lifting cylinders 26 are mounted on an intermediate platform 28 which is part of the furnace body 29 which subsequently explained in further detail.

The suction piece 30 disposed in the upper partial segment 30 leads to a vacuum pumping device 31 which is known as such and disposed in a pump chamber 32.

The furnace body 29 has a top platform 33 on which is disposed a driving mechanism 34 configured as a geared motor for the lifting and lowering of the electrode supporting rod 15. This is carried out by means of a lifting spindle 35 and a spindle nut 36 which, in turn, is disposed on a cross arm 37. In order to avoid a twisting of the spindle nut 36 and the cross arm 37 the ends of the cross arm are guided in vertical guiding bars 38 and 39 which are supported inside the furnace body in a way not described in further detail. It is also possible to place the platform 33 on weight measuring cells so as to be able to continuously monitor the weight changes of the consumable electrode during the remelting processes. Further, the remelting plant includes a power source 40 to supply the melting current. In a way not described in further detail the positive pole 41 is connected to the upper partial segment 13 of the furnace upper portion 11 via a pipe 42 whereas the negative pole 43 is, via two trailing cables 44, connected to the cross arm 37 and hence, the electrode supporting rod 15. It is understood that the electrode supporting rod 15 is electrically insulated with respect to the furnace upper portion and the upper partial segment 13.

In order to be able to remove the individual furnace lower portions 6 and 7 from the area of the furnace axis A—A a transferring device, not described in further detail, is provided which can be configured, for example, as a rotary driving mechanism for platform 5.

The revolving principle of the remelting plant in accordance with FIG. 1 can basically be gathered from FIG. 2.

FIG. 3 shows a partial section from the center of FIG. 1 in an enlarged scale, the top end, that is, of the lower partial segment 19 of the furnace upper portion 11 including the valve chamber 20 and the bottom end of the upper partial segment 13. Also illustrated is the bottom end of the electrode supporting rod 15 to which is attached the supporting piece 24 of the consumable electrode 23 which is indicated in FIG. 3 only by a broken line. In valve chamber 20 there is a stop valve 46 disposed in form of a valve plate which is movably supported in bearings at a U-like bent rocker 47. At the left end of the valve chamber 20 the rocker 47 is pivotably supported in bearings and at the right end it can be lifted and lowered. It is thus possible to contact-free guide the stop valve 46 over its valve seat 48 and place it thereon by lowering it. The individual driving elements for carrying out this combined movement are omitted for reasons of clarity.

On the right side of the lower partial segment 19 there is a radial piece 49 to the front side 50 of which, parallel to the furnace axis A—A, an inspection window 51 is gas-tight disposed. This inspection window can thus be replaced and permits visually inspecting the relative position of the consumable electrode 23 and the supporting piece 24 to the electrode supporting rod 15 in order to thus permit a coaxial coupling of the electrode to the supporting rod. The optical axis of the inspection window is referenced as 0—0.

In order to provide a centering in case of a possible eccentricity after the furnace is closed three centering devices 52, only one of which is illustrated, are disposed in the top area of the circumference of the lower partial segment 19. Said devices include a pressure medium cylinder 53 which is surrounded by a guiding pipe 54 which is telescope-like led into an external pipe 55. It is thus possible to finally center the bottom end of the electrode before the starting phase and thus enlarge the diameter ratio of electrode to ingot mold because of the simple reason that the safety distance against short circuits can be reduced.

This centering device can advantageously be used to keep the "stub" inclusive of the non-consumed, discoidal rest of the consumable electrode above the melt and the ingot after the stop valve is closed.

The following are further embodiments of the invention:

In the area of the separating groove 22 between the upper and the lower partial segment of the furnace upper portion the height of lifting/lowering which is already small as such can be completely avoided in that the separating groove is provided with an inflatable sealing element.

Individual partial segments of the furnace upper portion 11 can be provided with wall elements which can be telescoped so as to adjust the length of the furnace upper portion to various electrode lengths.

Furthermore, two visual inspection windows 51 can be disposed on diametrically opposed sides of the furnace upper portion.

While the power source 40 has been described as a direct voltage source it is of course also possible to operate the remelting plant on alternating voltage, for example, on supply voltage or a significantly lower alternating frequency.

The disposal of the valve chamber 20, too, is not limited to the position at the top end of the lower partial segment; it is also possible to dispose the valve chamber 20 between the ingot mold flange 10 and the bottom sealing flange 21 of the lower partial segment 19 since the metal of the consumable electrode 23 is completely inside the ingot mold 9 once the remelting is completed. However, when the valve chamber 20, as represented in FIGS. 1 and 3, is disposed at the top end of the lower partial segment 19 the stop valve 46 is exposed to a significantly reduced heat radiation load, i.e. during normal operation a particularly required cooling of the valve disk is not necessary.

Also, the position of the separating groove 22 need not necessarily be horizontal; deviations in angle are possible without problems; however, the horizontal alignment of the separating groove is to be preferred.

In connection with the described embodiments the charging procedure was explained based on a transverse dislocation of the furnace lower portions. However, as an alternative it is also possible to rigidly mount the furnace lower portions and to transversely place the furnace upper portion including the furnace body.

I claim:

1. Closed remelting furnace having a vertical furnace axis along which an electrode supporting rod for a consumable electrode can be moved, comprising:

a furnace body which has a driving mechanism for an electrode supporting rod for a consumable electrode;

a furnace upper portion including an electrode supporting rod for a consumable electrode;

several furnace lower portions each of which includes an ingot mold which has an ingot mold axis and can individually, if desired, be aligned with the furnace axis by a lateral relative movement with respect to the furnace upper portion;

said furnace upper portion including an upper limiting wall having a gas-tight sealed passage through which the electrode supporting rod passes;

a device for generating a protective atmosphere and said furnace upper portion being connected therewith and in a melting position being concentrically aligned with the furnace axis and adapted to be gas-tight with one of the furnace lower portions;

a separating groove for vertically subdividing the furnace upper portion into two partial segments, of which an upper partial segment including said upper limiting wall is configured to be short as compared to the total height of the furnace upper portion and is associated with the electrode supporting rod and of which a lower partial segment is movable out of the vicinity of the furnace axis.

2. Remelting furnace in accordance with claim 1, in which the lower partial segment of the furnace upper portion has a jacket including a sealing flange at a bottom end thereof which can be gas-tight connected to an ingot mold of a furnace lower portion.

3. Remelting furnace in accordance with claim 2, in which the jacket has a valve chamber and a vacuum valve.

4. Remelting furnace in accordance with claim 2, in which the jacket has at least one visual inspection window.

5. Remelting furnace in accordance with claim 3, in which the upper region of the valve chamber has a counter sealing flange and in which the upper partial segment of the furnace upper portion comprises a jacket including a sealing flange at a bottom end thereof which is adapted to be gas-tight connected to the counter sealing flange of the valve chamber.

6. Remelting furnace in accordance with claim 5, which includes a device for generating a protective atmosphere and in which the jacket of the upper partial segment has a connecting piece to connect to the device for generating a protective atmosphere.

7. Remelting furnace in accordance with claim 1, which includes an axially effective driving mechanism and in which the furnace lower portion and the lower partial segment of the furnace upper portion when placed thereon is gas-tight connected to the upper partial segment of the furnace upper portion by relative movement caused by the axially effective driving mechanism.

8. Remelting furnace in accordance with claim 7, in which the axial driving mechanism comprises a lifting drive mechanism acting upon the upper partial segment of the furnace upper portion.

9. Remelting furnace in accordance with claim 8, in which the axial driving mechanism has a length of lift of 5 to 50 mm.

10. Remelting furnace in accordance with claim 1, in which the furnace upper portion 11 includes a centering device for the consumable electrode.

11. Remelting furnace in accordance with claim 1, which includes a rotatable platform and in which the furnace lower portion including the ingot mold inserted therein is disposed on the rotatable platform.

12. Remelting furnace in accordance with claim 11, in which the rotatable platform is disposed in a cylindrical pit and which includes at least one separating wall which basically fills out the cross section of the pit and is disposed between the individual furnace lower portions which are in radial alignment.

13. Remelting furnace in accordance with claim 1, in which the lower partial segment of the furnace upper portion includes a centering device for centering the consumable electrode with respect to the electrode supporting rod.

* * * * *